United States Patent [19]

Kato et al.

[11] Patent Number: 4,542,363

[45] Date of Patent: Sep. 17, 1985

[54] OPEN FUSE CUTOUT

[75] Inventors: Kazuaki Kato, Chita; Yuzo Nishi, Toki, both of Japan

[73] Assignees: NKG Insulators, Ltd., Nagoya; Takamatsu Electric Works, Ltd., Inuyama, both of Japan

[21] Appl. No.: 605,956

[22] Filed: May 1, 1984

[30] Foreign Application Priority Data

May 10, 1983 [JP] Japan ..... 58-69515[U]

[51] Int. Cl.[4] ..... H01H 39/00; H01H 71/10

[52] U.S. Cl. ..... 337/31; 337/168; 361/132

[58] Field of Search ..... 337/1, 4, 28, 31, 32, 337/167, 168; 361/38, 39, 131, 132

[56] References Cited

U.S. PATENT DOCUMENTS 2,519,289 8/1950 Roman et al. ..... 337/31

*Primary Examiner*—Harold Broome

*Attorney, Agent, or Firm*—Jordan and Hamburg

[57] ABSTRACT

An open fuse cutout has a built-in lightning arrester. A supporting insulator has an attachment hole extending substantially perpendicularly to the axis thereof with the lightning arrester element fixedly fitted in the attachment hole. The lightning arrester element has a charging electrode held in abutment against either one of upper and lower electrodes, and a grounding electrode confronting a grounding member across a spark gap.

5 Claims, 4 Drawing Figures

OPEN FUSE CUTOUT

BACKGROUND OF THE INVENTION

1. Field of the Invention

The present invention relates to an open fuse cutout with a built-in lightning arrester.

2. Description of the Prior Art

Lightning arresters for protecting open fuse cutouts from a lightning stroke have conventionally been provided as being separate from the open fuse cutout. When the open fuse cutout is to be installed on a pole, it is necessary to reserve a space for attachment of the lightning arrester, and it is tedious and time-consuming to mount the open fuse cutout. Another problem is that the lightning arrester as installed results in a poor appearance of the assembly on the pole.

SUMMARY OF THE INVENTION

It is an object of the present invention to provide an open fuse cutout which will reliably protect itself from a lightning surge to prevent any unwanted accident which would otherwise be result from such a lightning surge.

Another object of the present invention is to provide an open fuse cutout in which an first electrode or a second electrode is also used as a conductive member connected to a lightning arrester element, thereby dispensing with a separate conductive member and hence eliminating the number of parts required.

Still another object of the present invention is to provide an open fuse cutout having a lightning arrester element which can easily be attached to a supporting insulator without the use of a special attachment tool.

A still further object of the present invention is to provide an open fuse cutout which can be mounted in position without impairing the appearance thereof.

According to the present invention, an open fuse cutout is provided comprising a mounting member, a supporting insulator supported on the mounting member and having an attachment hole extending substantially perpendicularly to an axis of the supporting insulator, first and second electrodes mounted on the supporting insulator, a fuse tube extending between and supported on the first and second elecrodes, a grounding member attached to the mounting member, a lightning arrester element disposed in the attachment hole and covered fully with an insulating material, the lightning arrester element having a charging electrode and a grounding electrode, the charging electrode and one of the first and second electrodes forming a first confronting pair and the grounding electrode and the grounding member forming a second confronting pair, at least one of the first and second confronting pairs having a spark gap.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
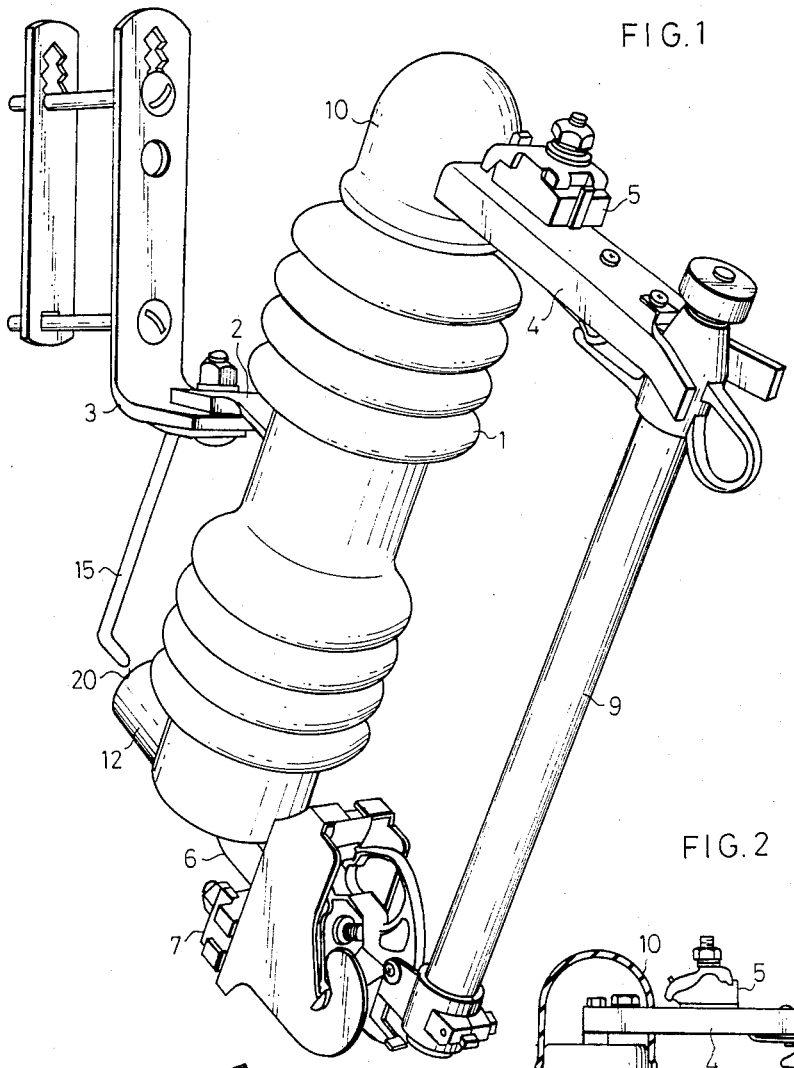
FIG. 1 is a perspective view of an open fuse cutout according to an embodiment of the present invention which embodies the principles of the invention.
Figure 2:
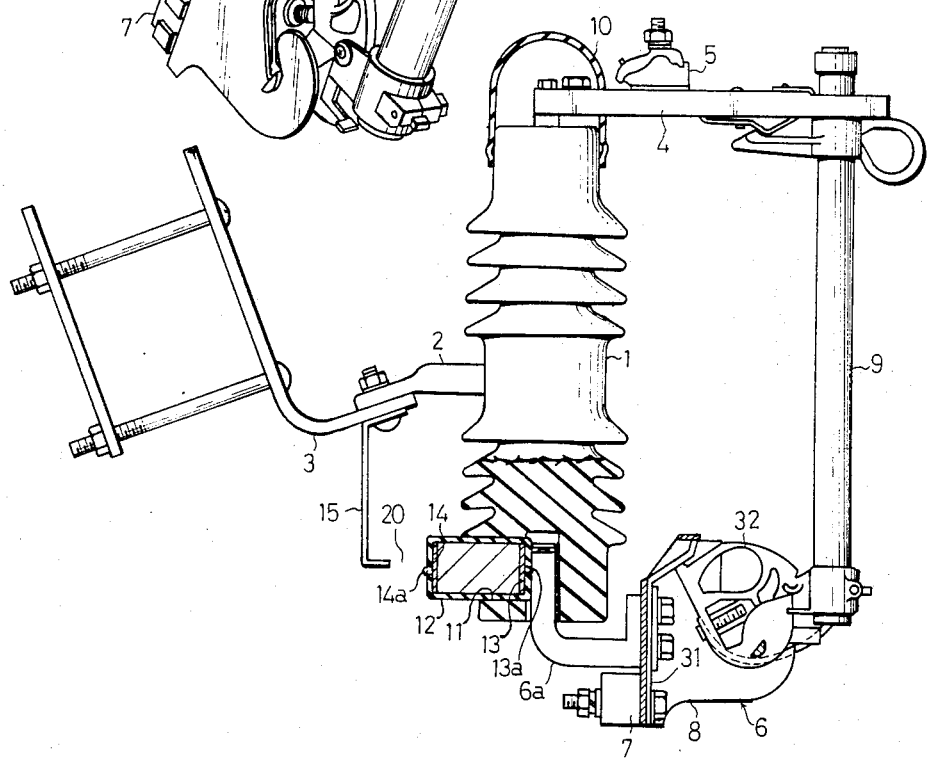
FIG. 2 is a front elevational view of the open fuse cutout of FIG. 1, with a protective cap, a lightning arrester element, and a holder shown in cross section.

As shown in FIGS. 1 and 2, an open fuse cutout according to an embodiment of the present invention includes a supporting insulator 1 supported by a mounting member 2 on a bracket 3 attached to a pole (not shown). An upper electrode 4 projects laterally from an first end of the supporting insulator 1 and has a connector terminal 5 for connection to a power supply. A lower member 6 projects laterally from a lower end of the supporting insulator 1 and supports a holder 8 secured thereto and having a connector terminal 7 for connection to a load. A fuse tube 9 which contains a fuse (not shown) therein has a lower end supported on the holder 8 for lateral angular displacement. The lower member 6 serves as a portion of a second electrode 6*a* for coaction with the upper electrode 4. The second electrode 6*a* and the connector terminal 7 are electrically connected to the lower end of the fuse through a conductive plate 31 and a toggle member 32 made of a conductive material. The fuse tube 9 has an upper end detachably supported by a distal end of the second electrode 4.

On the upper end of the supporting insulator 1, there is mounted a bird-proof protective cap 10 molded of an insulating material such as synthetic resin for protecting the open fuse cutout against the ground-fault by birds or other animals.

The lower end of the supporting insulator 1 has an attachment hole 11 extending from an outer peripheral surface to the center thereof, that is, opening in a direction substantially perpendicular to the axis of the supporting insulator 1. A lightning arrester element 12 has one end fixedly fitted in the attachment hole 11. The lightning arrester element 12 is in the form of a rod comprising a non-linear resistor made primarily of sintered zinc oxide (ZnO) and having good non-follow-current characteristics.

A charging electrode 13 is electrically connected as by brazing to one end of the lightning arrester element 12 and has a projecting terminal 13*a*. A grounding electrode 14 is electrically connected as by brazing to the other end of the lightning arrester element 12 and has a projecting discharger 14*a*. The lightning arrester element 12, excluding the terminal 13*a*and the discharger 14*a*, is wrapped in an insulating material. The axis of the lightning arrester element 12 extends substantially perpendicularly to the axis of the supporting insulator 1 with the terminal 13*a* held in abutting engagement with a proximal end of the second electrode 6*a* in the supporting insulator 1.

A grounding member 15 is fixed at a proximal end thereof to the mounting member 2 and has a distal end extending downwardly to a position spaced to define a spark gap 20 with the discharger 14*a*.

The open fuse cutout thus constructed will operate as follows: In the position shown in FIGS. 1 and 2, a circuit is completed from the connector terminal 5 to the first electrode 4 to the fuse (not illustrated) to the holder 8 to the connector terminal 7. The circuit can be broken by angularly moving the fuse tube 9 laterally about the holder 8 from the illustrated position to bring the upper end of the fuse tube 9 out of engagment with the first electrode 4.

When an abnormal voltage such as a lightning surge is applied from the power supply to the open fuse cutout, flashover occurs through the spark gap 20 between the discharger 14*a* of the lightning arrester element 12 and the grounding member 15, and a current is discharged from the second electrode 6*a* via the spark gap 20 to the grounding member 15. Therefore, any distributor devices connected to the open fuse cutout and load will not be damaged by the lightning surge. Since the lightning arrester element 12 is fixedly fitted in the attachment hole 11 in the supporting insulator 1, there is no need for attachments to attach the lightning arrester element 12 in position. The spark gap 20 may be provided on both of the charging electrode 13 and the grounding electrode 14.

Figure 3:
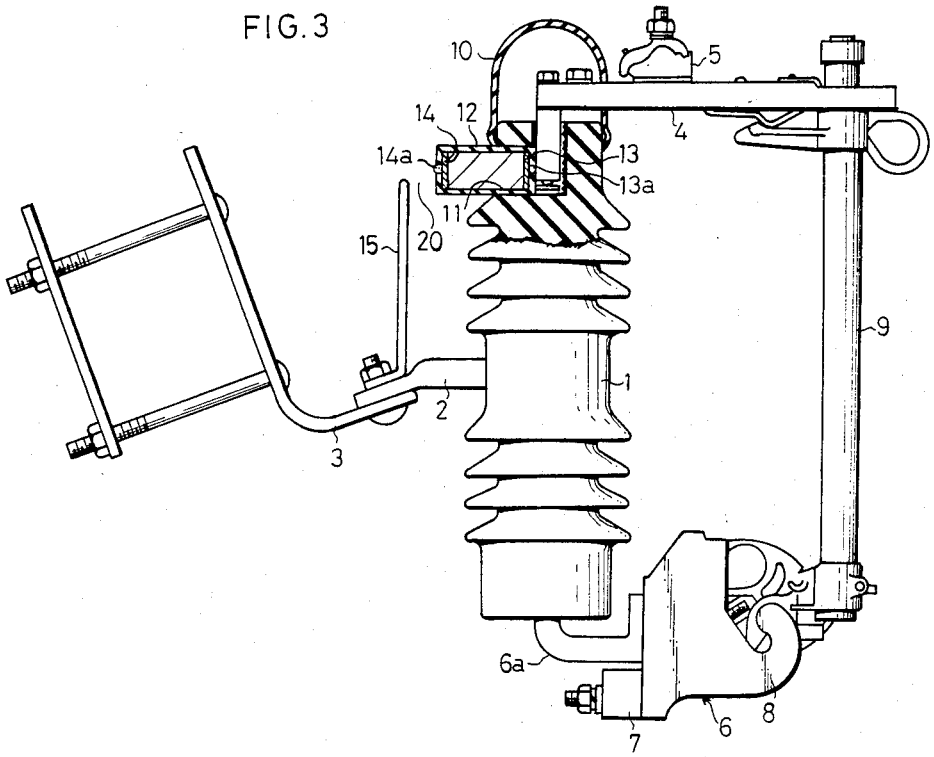
FIGS. 3 and 4 are front elevational views of open fuse cutouts according to other embodiments of the present invention, each view showing a protecting cap and a lightning arrester element in cross section.

FIG. 3 illustrates an open fuse cutout according to a second embodiment of the present invention, which differs from the open fuse cutout of FIGS. 1 and 2 in that a lightning arrester element 12 has one end fixedly fitted in an attachment hole 11 defined in an upper end of a supporting insulator 1 and exending from an outer peripheral surface thereof to the center thereof. A charging electrode 13 has a terminal 13*a* held in abutment against the proximal end of an first electrode 4 in the supporting insulator 1. A grounding electrode 14 has a discharger 14*a* projecting and exposed out from the other end of the lightning arrester element 12. A grounding member 15 for draining a discharged current from the discharger 14*a* to ground has a proximal end fixed to the mounting member 2 and extends upwardly to a position spaced a prescribed spark gap 20 from the discharger 14*a*.

The open fuse cutout of the above construction will operate in the same manner as that of the open fuse cutout of the first embodiment. Since the lightning arrester element 12 is fixedly fitted in the supporting insulator 1, the lightning arrester element 12 and the open fuse cutout are of an integral construction. The lightning arrester element 12 can be mounted on the supporting insulator 1 without the need for any special separate attachment tool.

Figure 4:
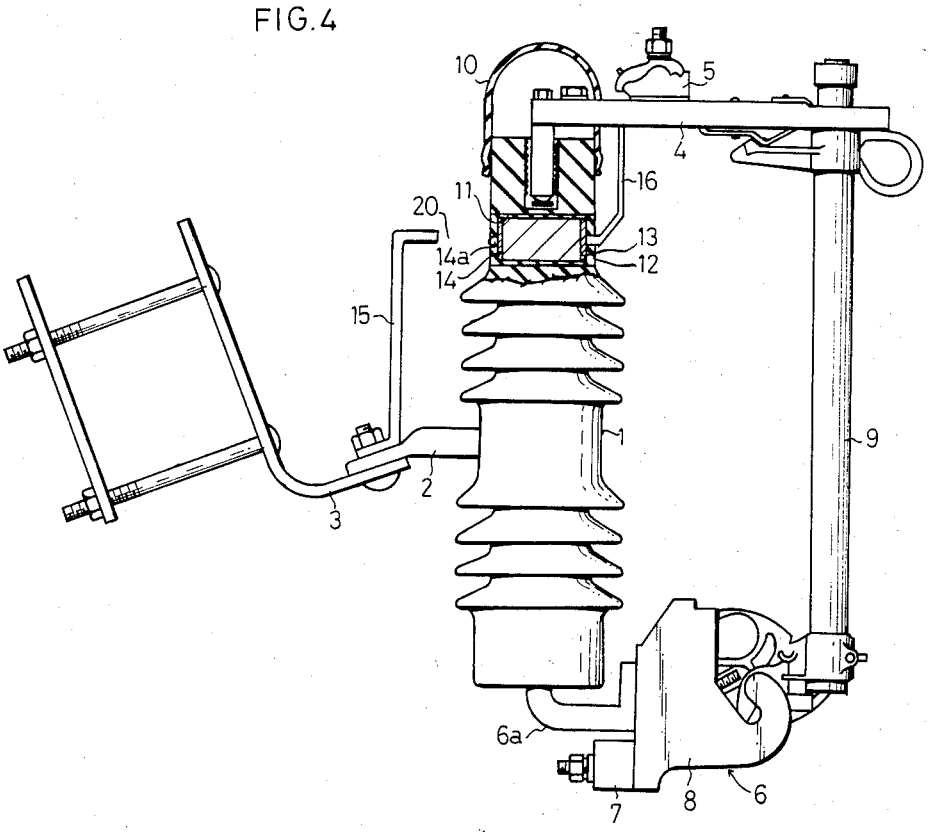

According to a third embodiment shown in FIG. 4, a lightning arrester element 12 is fitted in an attachment hole 11 defined diametrically through a supporting insulator 1 and positioned below an first electrode 4. A charging electrode 13 is electrically connected by a connector wire 16 to the first electrode 4. The open fuse cutout of the third embodiment has the same advantages as those of the first and second embodiments.

With the arrangement of the present invention, as described above, the lightning arrester element is fixedly fitted in the attachment hole in the supporting insulator, and first electrode or the second electrode can double as a conductive member connected to the lightning arrester element. Therefore, the number of parts used is be reduced. The open fuse cutout is protected by the lightning arrester from a lightning surge to prevent undesired accidents which would otherwise be caused by such a lightning surge. The lightning arrester element can be attached with ease without using any special attachment tool. Since the lightning arrester and the open fuse cutout as they are assembled are of an integral construction, they are installed in position without being impaired in appearance.

Although certain preferred embodiments have been shown and described, it should be understood that many changes and modifications may be made therein without departing from the scope of the appended claims.

What is claimed is:

1. An open fuse cutout comprising:

(a) a mounting member;

(b) a supporting insulator supported on said mounting member and having an attachment hole extending substantially perpendicularly to an axis of the supporting insulator;

(c) first and second electrodes mounted on said supporting insulator;

(d) a fuse tube extending between and supported on said first and second electrodes;

(e) a grounding member attached to said mounting member;

(f) a lightning arrester element disposed in said attachment hole and covered fully with an insulating material, the axis of said lightning arrester element extending transversely of the axis of said supporting insulator, said lightning arrester element having a charging electrode and a grounding electrode extending through said insulating material on opposite ends of said lightning arrester element, said charging electrode and one of said frist and second electrodes forming a first confronting pair and said grounding electrode and said grounding member forming a second confronting pair; and (g) at least one of said first and second confronting pairs defining a spark gap.

2. An open fuse cutout according to claim 1, wherein said lightning arrester element is mounted on said supporting insulator with said grounding electrode projecting laterally out of said attachment hole.

3. An open fuse cutout according to claim 2, wherein said lightning arrester element is mounted on a lower portion of said supporting insulator, said grounding electrode having a discharger projecting out of the insulating material and disposed in confronting relation to said grounding member across said spark gap, said charging electrode having a terminal abutting against said second electrode in said supporting insulator.

4. An open fuse cutout according to claim 2, wherein said lightning arrester element is mounted on an upper portion of said supporting insulator, said grounding electrode having a discharger projecting out of the insulating material and disposed in confronting relation to said grounding member across said spark gap, said charging electrode having a terminal abutting against said first electrode in said supporting insulator.

5. An open fuse cutout according to claim 1, wherein said lightning arrester element extends diametrically in an upper poriton of said supporting insulator, said grounding electrode having a discharger projecting out of the insulating material and disposed in confronting relation to said grounding member across said spark gap, said charging electrode being connected by a connector wire to said first electrode.

* * * * *

UNITED STATES PATENT AND TRADEMARK OFFICE

CERTIFICATE OF CORRECTION

PATENT NO. : 4,542,363

DATED : September 17, 1985

INVENTOR(S) : Kazuaki Kato and Yuzo Nishi

It is certified that error appears in the above-identified patent and that said Letters Patent are hereby corrected as shown below:

Title page:

In the section of assignees, change "NKG Insulators, Ltd." to

--NGK Insulators, Ltd.--

Signed and Sealed this

*Eleventh* Day of *February 1986*

[SEAL]

*Attest:*

DONALD J. QUIGG

*Attesting Officer*

*Commissioner of Patents and Trademarks*